US007391426B2

(12) United States Patent
Yun

(10) Patent No.: US 7,391,426 B2
(45) Date of Patent: Jun. 24, 2008

(54) METHOD AND APPARATUS FOR ADJUSTING ALIGNMENT OF IMAGE FORMING DEVICE

(75) Inventor: Young-jung Yun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 462 days.

(21) Appl. No.: 11/190,020

(22) Filed: Jul. 27, 2005

(65) Prior Publication Data

US 2006/0033801 A1 Feb. 16, 2006

(30) Foreign Application Priority Data

Aug. 14, 2004 (KR) ..... 10-2004-0064124

(51) Int. Cl.
*B41J 2/325* (2006.01)

(52) U.S. Cl. ..... 347/179

(58) Field of Classification Search ..... 347/179, 347/19, 14, 5

See application file for complete search history.

(56) References Cited

U.S. PATENT DOCUMENTS 5,450,099 A 9/1995 Stephenson et al.

7,163,273 B2 * 1/2007 Silverbrook ..... 347/19

FOREIGN PATENT DOCUMENTS

| | | |
|---|---|---|
| JP | 60-210468 | 10/1985 |
| JP | 2000-246940 | 9/2000 |
| JP | 2003-156974 | 5/2003 |
| KR | 10-0218702 | 4/1997 |

* cited by examiner

*Primary Examiner*—K. Feggins
(74) *Attorney, Agent, or Firm*—Roylance, Abrams, Berdo & Goodman, LLP

(57) ABSTRACT

A method and apparatus for adjusting the alignment of an image forming device using two thermal heads, wherein the method includes the steps of (a) printing first and second predetermined patterns on the medium by using the first and second thermal heads, respectively, (b) detecting a distance difference of print positions between the first and second thermal heads by using the printed patterns, and (c), based on the detected distance difference, transforming image data printed by the thermal heads to adjust the alignment in sub-pixel units. Therefore, a distance difference of printing positions of the thermal heads can be compensated by detecting the distance difference between the printing positions of the thermal heads, and moving the target image data by the detected distance difference. As a result, the alignment of the thermal heads can be easily and accurately adjusted.

19 Claims, 7 Drawing Sheets

FIG. 10A

| | | | | | | | |
|---|---|---|---|---|---|---|---|
| $B_1$ | $B_2$ | $B_3$ | $B_4$ | $B_5$ | $B_6$ | $B_7$ | $B_8$ |

.....

FIG. 10B

| | | | | | | | | | |
|---|---|---|---|---|---|---|---|---|---|
| 0 | 0 | $B_1$ | $B_2$ | $B_3$ | $B_4$ | $B_5$ | $B_6$ | $B_7$ | $B_8$ |

.....

FIG. 11A

| | | | | | |
|---|---|---|---|---|---|
| 0 | 0 | $B_1$ | $B_2$ | $B_3$ | $B_4$ |

.....

FIG. 11B

| | | | | | |
|---|---|---|---|---|---|
| 0 | 0 | $B_1+(0-B_1)\times0.2$ | $B_2+(B_1-B_2)\times0.2$ | $B_3+(B_2-B_3)\times0.2$ | $B_4+(B_3-B_4)\times0.2$ |

.....

METHOD AND APPARATUS FOR ADJUSTING ALIGNMENT OF IMAGE FORMING DEVICE

CROSS-REFERENCE TO RELATED APPLICATIONS

This application claims the benefit under 35 U.S.C. 119(a) of Korean Patent Application No. 10-2004-0064124, filed in the Korean Intellectual Property Office on Aug. 14, 2004, the entire disclosure of which is incorporated herein by reference.

BACKGROUND OF THE INVENTION

1. Field of the Invention

The present invention relates to an image forming device using a thermal head. More specifically, the present invention relates to a method and apparatus for adjusting the alignment of a thermal head of an image forming device.

2. Description of Related Art

A thermal printing device typically refers to an image forming device for applying heat to an ink ribbon contacting a medium to move the ink to the medium, or for applying heat from a thermal head to a medium, where an ink layer reacting with the heat develops a predetermined color.

FIG. 1 is a cross sectional view of a typical thermal recording medium. The medium includes a base sheet 11 and ink layers provided on both sides of the base sheet 11, that is, first and second surfaces 10*a* and 10*b*, in predetermined colors. The ink layers are provided in different colors. For example, yellow (Y) and magenta (M) layers can be sequentially provided on the first surface 10*a*, and a cyan (C) layer can be provided on the second surface 10*b*. The base sheet 11 is preferably comprised of a transparent material. A reflective layer 13 is provided and reflects light from the first surface 10*a* to display color images.

FIG. 2 is a perspective view showing a typical arrangement of an image forming device using a thermal head. The image forming device of FIG. 2 comprises a thermal head 100, a thermal head nozzle 110, a platen roller 120, and a moving unit 130. The moving unit 130 comprises a motor 140, a driving roller 150, a driven roller 160, and a medium sensor 170.

The thermal head 100 applies heat to a medium moved by the moving unit 130. The thermal head nozzle 110 provides ink required in printing to the platen roller 120. Here, the medium is interposed between the thermal head 100 and the platen roller 120. The platen roller 120 supports the medium to adsorb the ink, and rotates according to the movement of the medium.

The motor 140 is comprised of a driving source for supplying a target medium to the thermal head 100. The driving roller 150 rotates while engaged with the motor 140 to move the medium. The driven roller 160 also rotates while engaged with the driving roller 150 to assist in moving the medium. Here, the medium is interposed between the driving roller 150 and the driven roller 160. The media sensor 170 is provided to detect a position of the target medium.

However, when the heat is applied to the thermal recording medium shown in FIG. 1, by using two thermal heads to make a color print on the medium as shown in FIG. 3, a screen may not be printed in designed colors due to a distance difference between the two thermal heads and a difference of the moving path of the medium. In this case, there is a need to adjust the alignment to match the printing positions of the two thermal heads.

Accordingly, a need exists for a system and method for adjusting the alignment of multiple thermal heads, and for moving data to compensate for the printing positions of the thermal heads.

SUMMARY OF THE INVENTION

The present invention substantially solves the above and other problems, and provides a method and apparatus for adjusting the alignment of thermal heads. The present invention provides a system and method which is capable of detecting a distance difference between printing positions of the thermal heads, and moving target image data by the detected distance difference to compensate for the distance difference of printing positions of the thermal heads.

According to an aspect of the present invention, a method is provided for adjusting the alignment of an image forming device using first and second thermal heads applying heat to a medium to print images, the method comprising the steps of (a) printing first and second predetermined patterns on the medium by using the first and second thermal heads, respectively, (b) detecting a distance difference of print positions between the first and second thermal heads by using the printed patterns, and (c), based on the detected distance difference, transforming image data printed by the thermal heads to adjust the alignment in subpixel units.

The first and second thermal heads may be fixed to the same frame.

The patterns may be printed such that an interval between the printed images of the thermal heads is changed in subpixel units.

The printing of the patterns may be performed such that the pixel data is corrected using a predetermined ratio of a distance difference between the pixel data of target images and the adjacent pixel data.

The distance difference between the printing positions of the first and second thermal heads may be detected by using the printed patterns. The operation of step (c) may then comprise the steps of moving one of the image data printed by the first and second thermal heads by a distance difference, in one pixel units of the detected distance difference, and correcting the moved image data by using a distance difference, in subpixel units of the detected distance difference.

The step of correcting the image data may be performed such that the pixel data of the moved image data is corrected using a distance difference between the pixel data of the moved image data and the adjacent pixel data thereto, by a ratio of difference in subpixel units of the detected distance difference.

In the operation of step (b), the distance difference between the printing positions of the first and second thermal heads in a secondary direction may be detected by using the printed patterns, and wherein the operation of step (c) may then comprise the steps of (c1) transforming the image data such that the target image is rotated 90 degrees, (c2) moving the transformed image data, in one pixel units of the detected distance difference, (c3) correcting the moved imaged data by using a distance difference, in subpixel units of the detected distance difference, and (c4) transforming the corrected image data such that the rotated image is rotated 90 degrees in the opposite direction to the rotation at the operation of step (c1).

The operation of step (c3) may be performed such that the pixel data of the moved image data is corrected using a predetermined ratio of a distance difference between the pixel data of the moved image data and the adjacent pixel data thereto, respectively, wherein the predetermined ratio may be comprised of a ratio of a distance difference in subpixel units of the detected distance difference.

According to another aspect of the present invention, a method is provided for micro-printing in an image forming device using thermal heads wherein the thermal heads apply heat to a medium to print images, the method comprising the steps of using a predetermined ratio of a distance difference between pixel data of the target images and the adjacent pixel data thereto to correct the pixel data of the target images, and printing the corrected image data on the medium by using the thermal heads.

According to another aspect of the present invention, an apparatus is provided for adjusting the alignment of an image forming device using thermal heads wherein the thermal heads apply heat to a medium to print images, the apparatus comprising a pattern printing unit for printing first and second predetermined patterns on the medium, a distance difference detection unit for detecting the distance difference between printing positions of the first and second thermal heads by using the printed patterns, and a data transforming unit for transforming the target image data to adjust the alignment in subpixel units.

The first and second thermal heads may be fixed to the same frame.

The pattern printing unit comprises a moving unit for moving the medium, first and second thermal heads for applying heat to the medium to print the images, and a print control unit for printing predetermined images on the medium in a predetermined interval, and controlling the moving unit and the first and second thermal heads to print first and second predetermined patterns.

The patterns may be printed to transform the interval between the printed images in subpixel units, and the distance difference detection unit may detect the distance difference between the first and second thermal heads in subpixel units by using the printed patterns.

The data transformation unit may comprise a data moving unit for moving one of the image data printed by the first and second thermal heads by a distance difference, in one pixel units of the detected distance difference, and a data correction unit for correcting the moved image data by using a distance difference, in subpixel units of the detected distance difference.

The data correction unit may correct pixel data of the moved image data by using a distance difference between the pixel data of the moved image data and the adjacent pixel data thereto, respectively, as a ratio of a distance difference in subpixel units of the detected distance difference.

The data transformation unit may further comprise a data rotation unit for converting the image data such that the target image is rotated 90 degrees.

According to another aspect of the present invention, a computer-readable medium is provided having embodied thereon a computer program for performing a method of aligning the image forming device and micro-printing.

BRIEF DESCRIPTION OF THE DRAWINGS

The above and other features and advantages of the present invention will become more apparent by describing in detail exemplary embodiments thereof with reference to the attached drawings, in which:

FIGS. 10A and 10B are diagrams showing an example of a method of moving image data in one pixel units according to an embodiment of the present invention;

FIGS. 11A and 11B are diagrams showing an example of a method of correcting image data by using a distance difference in subpixel units according to an embodiment of the present invention;

Throughout the drawings, like reference numerals will be understood to refer to like parts, components and structures.

DETAILED DESCRIPTION OF THE EXEMPLARY EMBODIMENTS

An exemplary method and apparatus for adjusting the alignment of an image forming device according to an embodiment of the present invention will now be described in greater detail with reference to the attached drawings.

Figure 1:
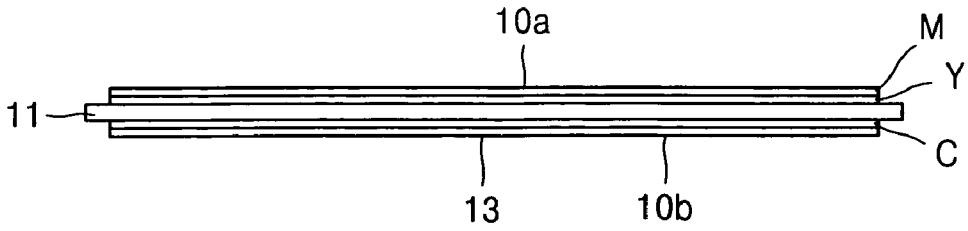
FIG. 1 is a cross sectional view showing a typical thermal recording medium.
Figure 2:
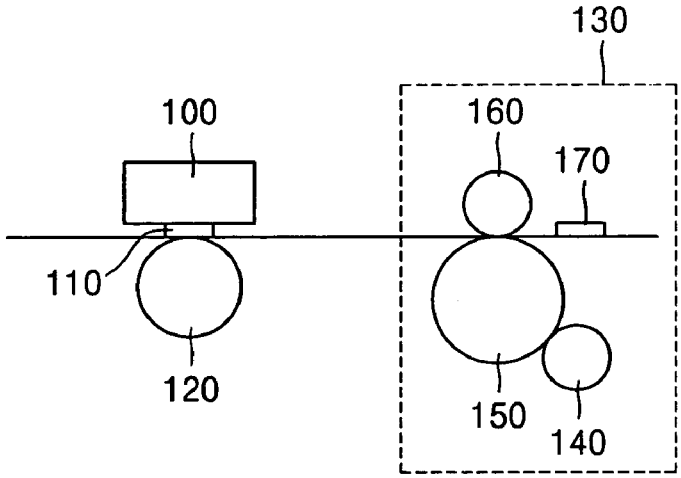
FIG. 2 is a perspective view showing a typical arrangement of an image forming device using a thermal head.
Figure 3:
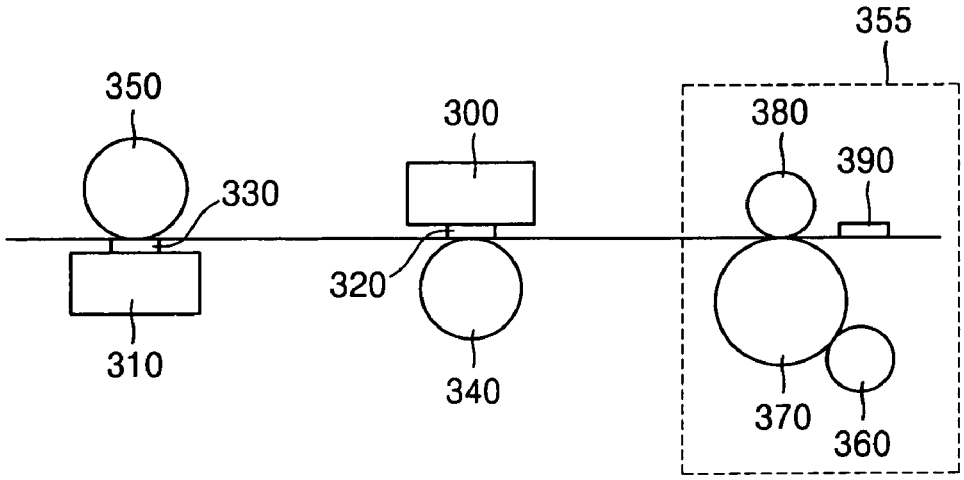
FIG. 3 is a perspective view showing an arrangement of an image forming device using first and second thermal heads.

FIG. 3 is a perspective view showing an arrangement of an image forming device using first and second thermal heads. The image forming device of FIG. 3 is comprised of first and second thermal heads 300 and 310, first and second thermal head nozzles 320 and 330, first and second platen rollers 340 and 350, and a moving unit 355. The moving unit 355 is comprised of a motor 360, a driving roller 370, a driven roller 380, and a medium sensor 390.

The first and second thermal heads 300 and 310 apply heat to the medium moved by the moving unit 355 to print target image data. The target image data may comprise yellow, magenta, and cyan data. Alternatively, the target image data may comprise red, green, and blue data. Where the image data comprises yellow, magenta, and cyan data, the first thermal head 300 applies heat to print the yellow and magenta data, and the second thermal head 310 applies heat to print the cyan data.

The first and second thermal head nozzles 320 and 330 supply ink required in printing to the first and second platen rollers 340 and 350, respectively. The medium is interposed between the first and second platen rollers 340 and 350 and the first and second thermal heads 300 and 310, respectively. The first and second platen rollers 340 and 350 support the medium such that the ink can be absorbed, and rotate according to the movement of the medium.

The motor 360 is comprised of a driving source for supplying the target medium to the first and second thermal heads 300 and 310. The driving roller 370 rotates while engaged with the motor 360 to move the medium. The driven roller 380 also rotates while engaged with the driving roller 370 to further assist in moving the medium. Here, the medium is interposed between the driving roller 370 and the driven roller 380. The medium sensor 390 is provided to detect a position of the target medium.

Figure 4:
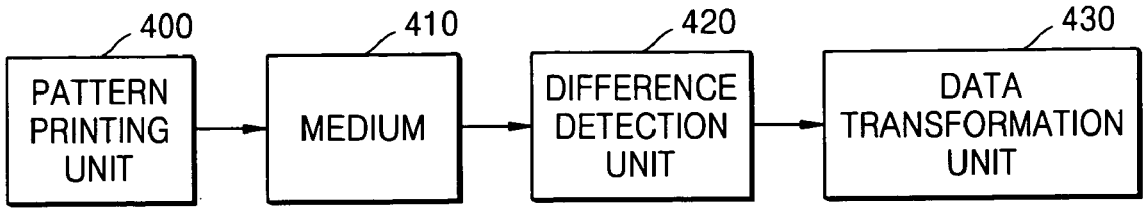
FIG. 4 is a block diagram showing an arrangement of an apparatus for adjusting the alignment according to an embodiment of the present invention.
Figure 13:
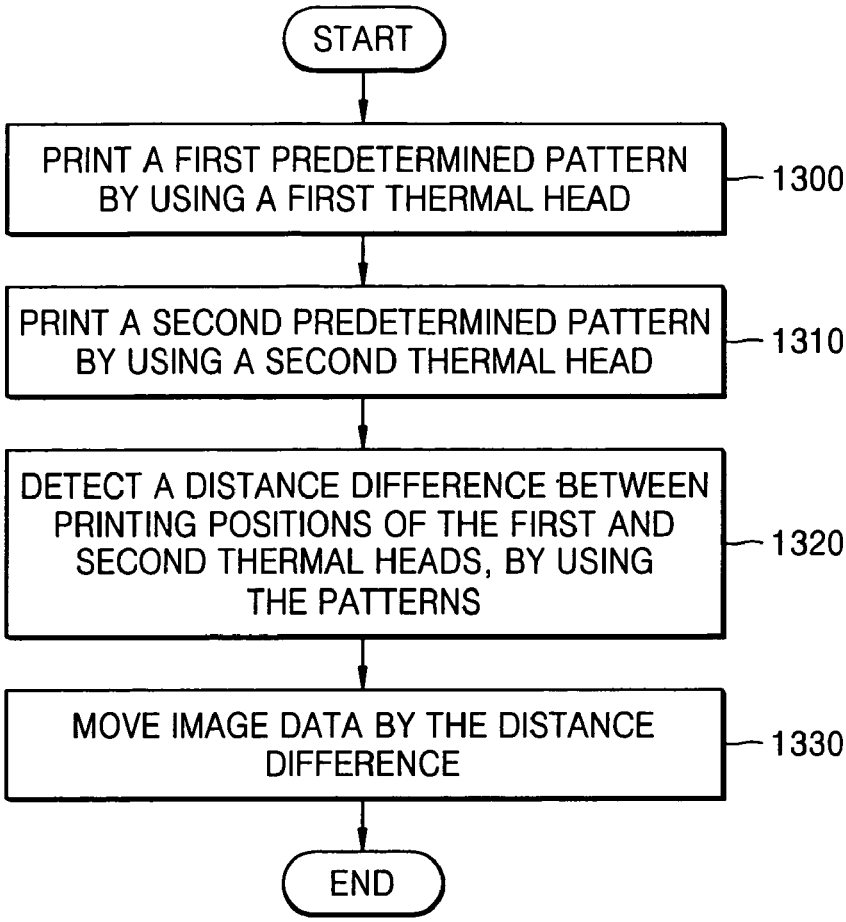
FIG. 13 is a flow chart showing a method of adjusting the alignment of an image forming device according to an embodiment of the present invention.

FIG. 4 is a block diagram showing an arrangement of an apparatus for adjusting the alignment according to an embodiment of the present invention. The apparatus of FIG. 4 is comprised of a pattern printing unit 400, a distance difference detection unit 420, and a data transformation unit 430. The apparatus shown in FIG. 4 will be described in greater detail with reference to the flow chart of FIG. 13. FIG. 13 is a flow chart showing a method of adjusting the alignment of an image forming device according to an embodiment of the present invention.

The pattern printing unit 400 prints a first predetermined pattern on the medium 410 at step (S1300), and then prints a second predetermined pattern on the medium 410 at step (S1310).

The distance difference detection unit 420 then detects a distance difference between printing positions of the first and second thermal heads 300 and 310 by using the first and second predetermined patterns printed on the medium 410 at step (S1320). Preferably, the distance difference detection unit 420 detects a location where the printing positions of the first and second predetermined patterns are matched to obtain the distance difference between the printing positions of the first and second thermal heads. In addition, preferably, the detection of the matched printing positions involves receiving the matched printing positions detected by the naked eye or by sensors. Further, preferably, the distance difference detection unit 420 detects the distance difference between the printing positions in subpixel units to accurately align the image forming device.

The data transformation unit 430 moves the image data printed by the first thermal head 300 or the image data printed by the second thermal head 310, based on the detected distance difference, to adjust the print positions at step (S1330). For example, in the case wherein the printing position of the first thermal head 300 is placed 0.1 mm to the right of the printing position of the second thermal head 310, the image data printed by the first thermal head 300 is moved to the left by the pixel value corresponding to 0.1 mm, or alternatively, the imaged data printed by the second thermal head 310 is moved to the right by the pixel value corresponding to 0.1 mm to adjust the printing positions.

Figure 5:
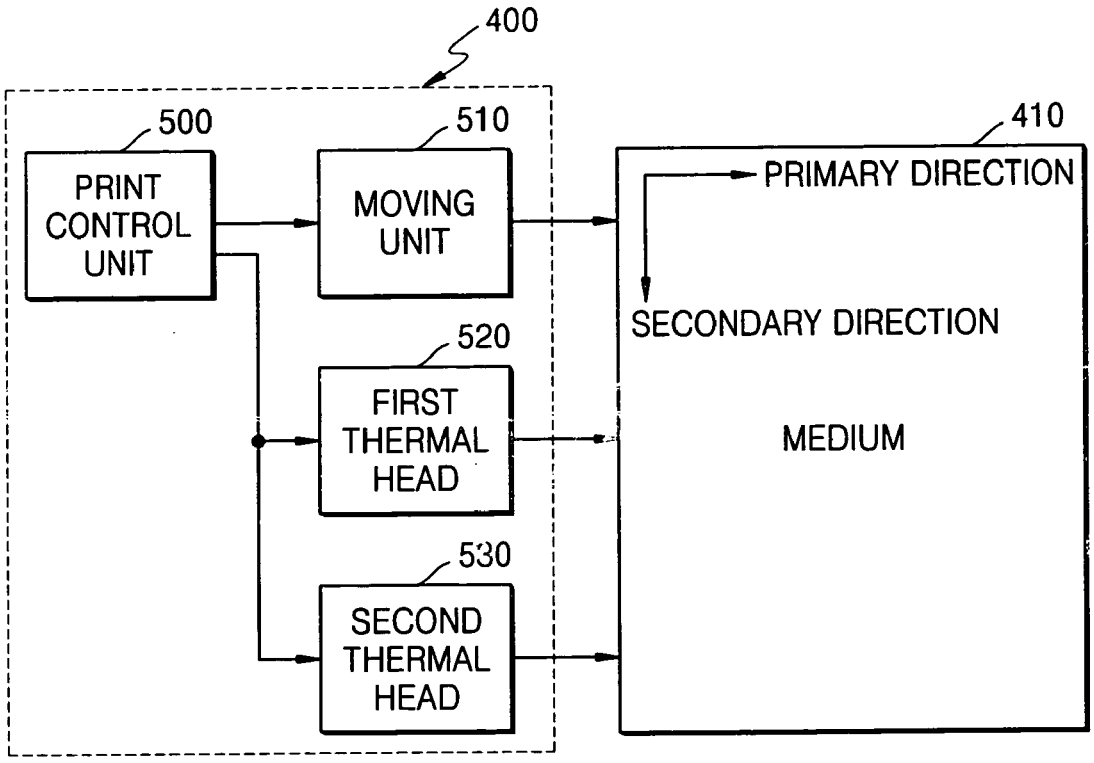
FIG. 5 is a detailed block diagram showing an example of a pattern printing unit of FIG. 4 according to an embodiment of the present invention.

FIG. 5 is a detailed block diagram showing an example of a pattern printing unit 400 of FIG. 4 according to an embodiment of the present invention. The pattern printing unit 400 is comprised of a print control unit 500, a moving unit 510, and first and second thermal heads 520 and 530, respectively.

Under the control of the print control unit 500, the moving unit 510 moves the medium 410, the first thermal head 520 applies heat to the moving medium 410 to print a first predetermined pattern, and the second thermal head 530 applies heat to the moving medium 410 to print a second predetermined pattern. As shown in FIG. 5, a secondary direction refers to a direction along which the medium 410 moves, and a primary direction refers to a direction perpendicular to the secondary direction. Preferably, the first and second predetermined patterns are printed such that an interval between the images is changed in subpixel units to allow the distance difference detection unit 420 to detect the distance difference between the printing positions of the thermal heads in subpixel units.

Preferably, to prevent a reoccurrence of a distance difference between the printing positions of the first and second thermal heads 520 and 530 after adjusting the alignment of the image forming device, the first and second thermal heads 520 and 530 are fixed to the same frame.

FIGS. 6A through 6D are diagrams showing an example of a method of printing patterns in subpixel units according to an embodiment of the present invention. The method involves printing patterns in subpixel units by using a pixel of the target image and two pixels to the left and right of the pixel.

Figures 6A, 6B, 6C, 6D:
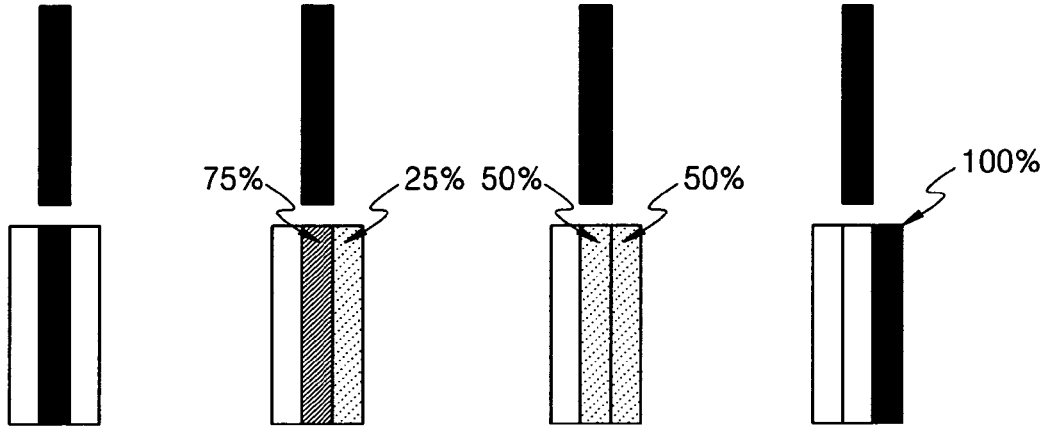
FIGS. 6A through 6D are diagrams showing an example of a method of printing patterns in subpixel units according to an embodiment of the present invention.

In FIG. 6A, the target image is printed without adjusting the printing position. In FIG. 6B, the target image is printed such that it appears to move to the right by about 0.25 pixels. Here, about 75% of the target image is printed at the center pixel, and about 25% of the target image is printed at the right pixel.

In FIG. 6C, the target image is printed such that it appears to move to the right by about 0.5 pixels. Here, about 50% of the target image is printed at the center pixel, and about 50% of the target image is printed at the right pixel.

In FIG. 6D, the target image is printed such that it appears to move to the right by about 1 pixel. Here, substantially all of the target image is printed at the right pixel.

Figure 7:
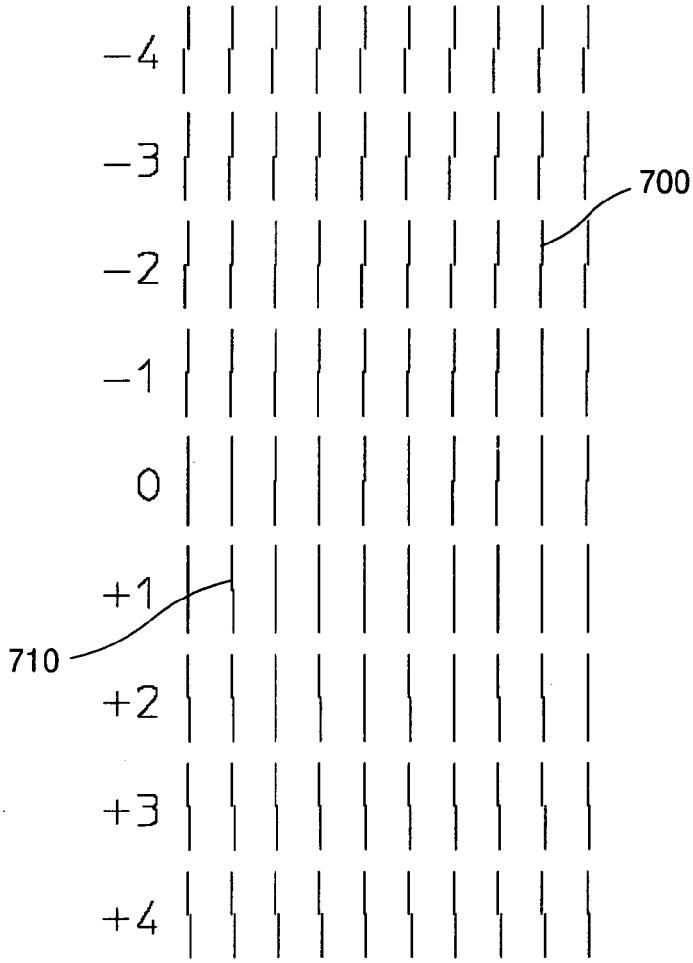
FIG. 7 is a diagram showing an example of patterns used to adjust the alignment in a primary direction of an image forming device according to an embodiment of the present invention.

FIG. 7 is a diagram showing an example of patterns used to adjust the alignment in a primary direction of the image forming device according to an embodiment of the present invention. The patterns are printed in increasing intervals of 0.1 pixels in a secondary direction between the printing positions of the first predetermined pattern printed by the first thermal head 520, and the second predetermined pattern printed by the second thermal head 530.

The patterns shown in FIG. 7 comprise 9 printing patterns (rows −4 through +4). Printing patterns in the middle (row 0) are printed such that the intervals between the two images respectively printed by the first and second thermal heads 520 and 530 correspond to about 0 pixels 0.1 pixels, 0.2 pixels, 0.3 pixels, 0.4 pixels, 0.5 pixels, 0.6 pixels, 0.7 pixels, 0.8 pixels, and 0.9 pixels, respectively.

The printing patterns right above the middle (row −1) are printed such that the intervals between the two images respectively printed by the first and second thermal heads 520 and 530 correspond to about −1 pixel, −1.1 pixels, −1.2 pixels, −1.3 pixels, −1.4 pixels, −1.5 pixels, −1.6 pixels, −1.7 pixels, −1.8 pixels, and −1.9 pixels, respectively.

The printing patterns right below the middle (row +1) are printed such that the intervals between the two images respectively printed by the first and second thermal heads 520 and 530 correspond to about 1 pixel, 1.1 pixels, 1.2 pixels, 1.3 pixels, 1.4 pixels, 1.5 pixels, 1.6 pixels, 1.7 pixels, 1.8 pixels, and 1.9 pixels, respectively.

The remaining printing patterns shown in FIG. 7 are printed such that the intervals between the two images respectively printed by the first and second thermal heads 520 and 530 correspond to about 2 to 2.9 pixels, 3 to 3.9 pixels, 4 to 4.9 pixels, −2 to −2.9 pixels, −3 to −3.9 pixels, and 4 to −4.9 pixels.

For example, when the printing positions of the two images printed by the first and second thermal heads 520 and 530 are matched at a position 700 shown in FIG. 7, the distance difference detection unit 420 detects that the printing position of the first thermal head 520 is placed about 2.8 pixels to the left of the printing position of the second thermal head 530 in the primary direction.

In addition, when the printing positions of the two images printed by the first and second thermal heads 520 and 530 are matched at a position 710, the distance difference detection unit 420 determines that the printing position of the first thermal head 520 is placed about 1.1 pixels to the right of the second thermal head 530 in the primary direction.

Figure 8:
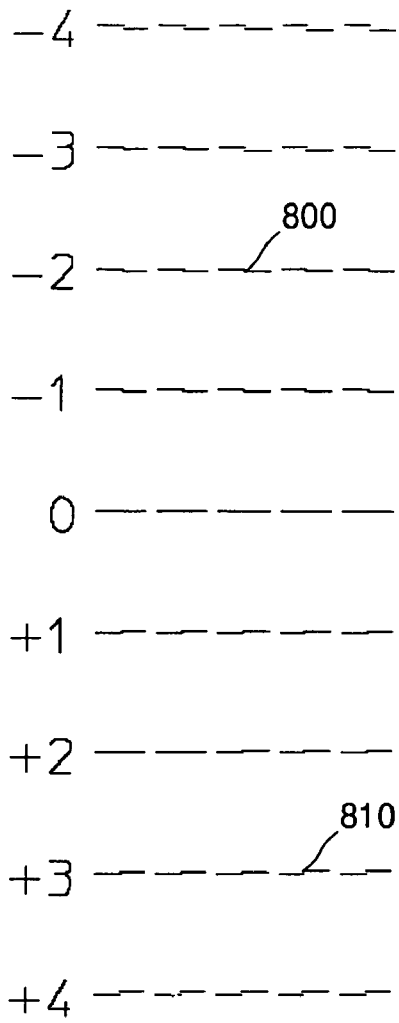
FIG. 8 is a diagram showing an example of patterns used to adjust the alignment in a secondary direction of an image forming device according to an embodiment of the present invention.

FIG. 8 is a diagram showing an example of patterns used to adjust the alignment in a secondary direction of the image forming device according to an embodiment of the present invention. The printing patterns in the middle (row 0) are printed such that the intervals between the two images printed by the first and second thermal heads 520 and 530 correspond to about 0 pixels, 0.2 pixels, 0.4 pixels, 0.6 pixels, and 0.8 pixels, respectively. The printing patterns right above the middle (row −1) are printed such that the intervals between the two images printed by the first and second thermal heads 520 and 530 correspond to about −1 pixel, −1.2 pixels, −1.4 pixels, −1.6 pixels, and −1.8 pixels, respectively.

The printing patterns right below the middle (row +1) are printed such that the intervals between the two images printed by the first and second thermal heads 520 and 530 correspond about 1 pixel, 1.2 pixels, 1.4 pixels, 1.6 pixels, and 1.8 pixels, respectively.

The remaining printing patterns shown in FIG. 8 are printed such that the intervals between the two images respectively printed by the first and second thermal heads 520 and 530 correspond to about 2 to 2.8 pixels, 3 to 3.8 pixels, 4 to 4.8 pixels, −2 to −2.8 pixels, −3 to −3.8 pixels, and −4 to −4.8 pixels, respectively.

For example, when the printing positions of the two images printed by the first and second thermal heads 520 and 530 are matched at a position 800 shown in FIG. 8, the distance difference detection unit 420 determines that the printing position of the first thermal head 520 is placed about 2.4 pixels to the left of the printing position of the second thermal head 530 in the secondary direction.

In addition, when the printing positions of the two images printed by the first and second thermal heads 520 and 530 are matched at a position 810, the distance difference detection unit 420 determines that the printing position of the first thermal head 520 is placed about 3.6 pixels to the right of the printing position of the second thermal head 530 in the secondary direction.

Figure 9:
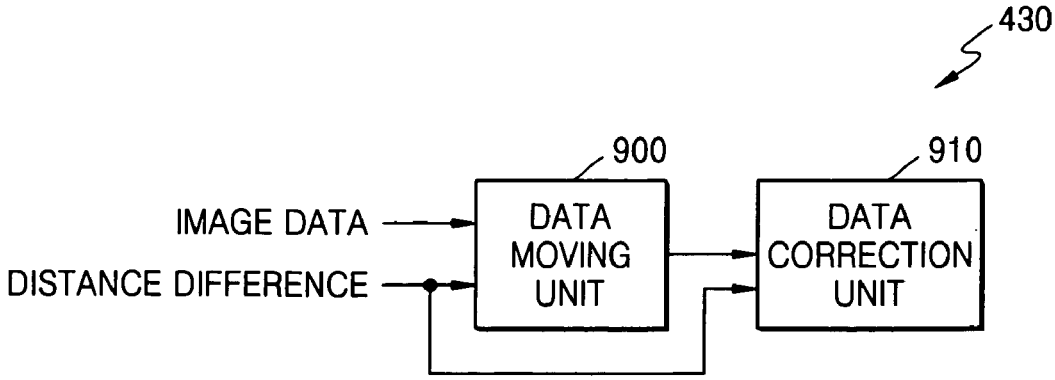
FIG. 9 is a detailed block diagram showing an example of a data transformation unit of FIG. 4 according to an embodiment of the present invention.
Figure 14:
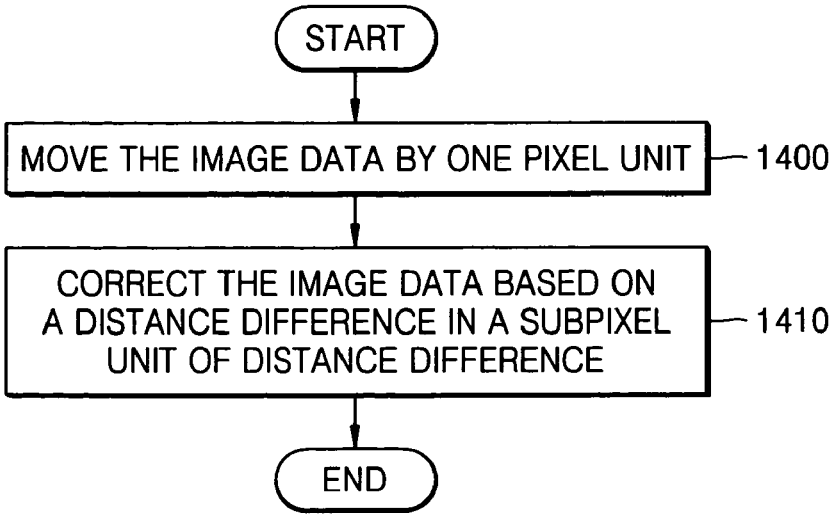
FIG. 14 is a detailed flow chart showing an example of a step of transforming image data based on a detected distance difference of FIG. 13 according to an embodiment of the present invention.

FIG. 9 is a detailed block diagram showing an example of the data transformation unit 430 of FIG. 4 according to an embodiment of the present invention. The data transformation unit 430 is comprised of a data moving unit 900 and a data correction unit 910. The apparatus shown in FIG. 9 will be described in greater detail with reference to the flow chart of FIG. 14. FIG. 14 is a detailed flow chart showing an example of a step of transforming image data based on a detected distance difference according to an embodiment of the present invention.

The data moving unit 900 receives the distance difference between the printing positions of the first and second thermal heads detected by the distance difference detection unit 420 to move the image data printed by the first or second thermal head, by one pixel units of the distance difference at step (S1400).

The data correction unit 910 corrects the moved image data by using a distance difference, in subpixel units of the distance difference between the printing positions of the first and second thermal heads detected by the distance difference detection unit 420 at step (S1410).

When the alignment of the image forming device is adjusted in the secondary direction, preferably, the data transformation unit 430 further includes an image rotation unit (not shown) for transforming the target image data to be rotated 90 degrees. Before the data moving unit 900 moves the image data, the image rotation unit rotates the image 90 degrees, and after the data transformation is completed, the image rotation unit preferably rotates the image 90 degrees in the direction opposite to the previous rotational direction.

FIGS. 10A and 10B are diagrams showing an example of a method of moving image data in one pixel units according to an embodiment of the present invention. Here, the first thermal head 520 prints red (R) and green (G) data, and the second thermal head 530 prints blue (B) data. In addition, the method involves moving the image data for a case wherein the distance difference between the printing positions of the first and second thermal heads 520 and 530 corresponds to 2.2 pixels.

The blue data printed by the second thermal head shown in FIG. 10A is moved by two pixels, which is a value based on the distance difference in one pixel units, and is transformed into the data shown in FIG. 10B.

FIGS. 11A and 11B are diagrams showing an example of a method of correcting image data by using a distance difference in subpixel units. Here, each pixel data is calculated as shown in the following Equation (1), $$B_n' = B_n + (B_{n-1} - B_n) \times D \quad (1)$$

wherein $B_n$ is a value of the nth blue data before correction, $B_n'$ is a value of the nth blue data after correction, and D is a value of subpixel units of the distance difference between the first and second thermal heads detected by the distance difference detection unit 420.

Therefore, in the case wherein the blue data printed by the second thermal head 530 shown in FIG. 11A is corrected based on 0.2 pixels, which is a value of subpixel units of the distance difference, $B_1$, $B_2$, $B_3$, and $B_4$, are corrected using a predetermined ratio of a distance difference between the pixel data of the moved images and the adjacent pixel data to the values, $B_1+(0-B_1)\times 0.2$, $B_2+(B_1-B_2)\times 0.2$, $B_3+(B_2-B_3)\times 0.2$, and $B_4+(B_3-B_4)\times 0.2$, respectively, as shown in FIG. 11B.

FIGS. 12A through 12D are diagrams showing an example of image data for adjusting the alignment in a secondary direction of an image forming device according to an embodiment of the present invention. The example involves moving the image data for a case wherein the distance difference between the printing positions of the first and second thermal heads corresponds to 1 pixel in the secondary direction.

Figure 12A:
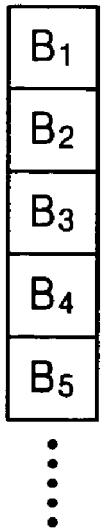
FIGS. 12A through 12D are diagrams showing an example of image data for adjusting the alignment in a secondary direction of an image forming device according to an embodiment of the present invention.
Figure 12B:
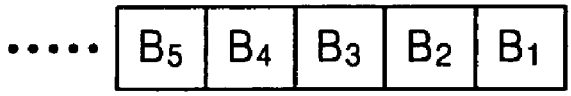
Figure 12C:
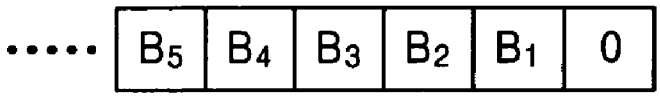
Figure 12D:
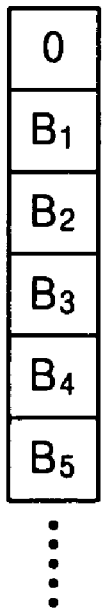

The blue data shown in FIG. 12A is transformed into the data shown in FIG. 12B, so that images are rotated 90 degrees. The transformed data is then moved by one pixel as shown in FIG. 12C. Next, the image rotation unit (not shown) transforms the data to be rotated 90 degrees in the direction opposite to the previous rotational direction.

In addition, embodiments of the present invention can be implemented as a computer readable medium having embodied thereon computer executable codes. The computer readable medium can be comprised of any type of recording device which can be read by a computer system. For example, the computer readable medium can be comprised of a ROM, RAM, CD-ROM, magnetic tape, floppy disk, optical data storage device, and any other medium, including those implemented as a carrier wave (for example, transmission via Internet). In addition, the computer readable medium may have embodied thereon computer executable codes distributed in computer systems connected in a network. Further, other functional programs, codes and code segments, used to implement embodiments of the present invention, can be easily construed by those skilled in the art.

As described above, according to a method and apparatus for adjusting the alignment of an image forming device, a distance difference between printing positions of thermal heads is exactly detected in subpixel units, and based on the detected distance difference, the target image data can be transformed to compensate for the distance difference of the printing positions of the thermal heads through means such as a software program. Therefore, the alignment of the image forming device can be easily and exactly adjusted.

While the present invention has been particularly shown and described with reference to exemplary embodiments thereof, it will be understood by those skilled in the art that various changes may be made therein without departing from the spirit and scope of the invention as defined by the following claims.

What is claimed is:

1. A method of adjusting alignment of an image forming device using at least first and second thermal heads, the method comprising the steps of:

(a) printing first and second predetermined patterns of images on a medium by using the first and second thermal heads, respectively;

(b) detecting a distance difference of print positions between the first and second thermal heads by using the first and second predetermined printed patterns; and (c) based on the detected distance difference, transforming image data printed by at least one of the first and second thermal heads to adjust alignment in subpixel units.

2. The method according to claim 1, wherein the first and second thermal heads are fixed to a frame.

3. The method according to claim 1, wherein the first and second predetermined patterns are printed such that an interval between the printed images is changed in subpixel units between the thermal heads.

4. The method according to claim 3, wherein the printing of the first and second predetermined patterns in subpixel units is performed such that pixel data of a target image is corrected by adding or subtracting a predetermined ratio of a distance difference between the pixel data and adjacent pixel data thereto, and printing the corrected pixel data.

5. The method according to claim 1, wherein step (b) comprises the step of:

detecting the distance difference between printing positions of the first and second thermal heads by using the first and second predetermined printed patterns.

6. The method according to claim 1, where step (c) comprises the steps of:

moving one of the image data printed by the first and second thermal heads by a distance difference, in one pixel units of the detected distance difference; and correcting the moved image data by using a distance difference, in subpixel units of the detected distance difference.

7. The method according to claim 6, wherein the correcting of the image data is performed such that pixel data of the moved image data is corrected by adding or subtracting a predetermined ratio of a distance difference between the pixel data of the moved image data and adjacent pixel data thereto, respectively, and wherein the predetermined ratio is comprised of a ratio of a subpixel difference of the detected distance difference.

8. The method according to claim 1, wherein step (b) comprises the step of:

detecting the distance difference between the printing positions of the first and second thermal heads in a secondary direction by using the first and second predetermined printed patterns.

9. The method according to claim 8, wherein step (c) comprises the steps of:

(c1) transforming the image data such that the target image is rotated 90 degrees;

(c2) moving the transformed image data, in one pixel units of the detected distance difference;

(c3) correcting the moved imaged data by using a distance difference, in subpixel units of the detected distance difference; and (c4) transforming the corrected image data such that the rotated image is rotated 90 degrees in the opposite direction to the rotation of step (c1).

10. The method according to claim 9, wherein step (c3) is performed such that pixel data of the moved image data is corrected by adding or subtracting a predetermined ratio of a distance difference between the pixel data of the moved image data and adjacent pixel data thereto, respectively, and wherein the predetermined ratio is comprised of a ratio of a distance difference in subpixel units of the detected distance difference.

11. An apparatus for adjusting alignment of an image forming device using thermal heads, the apparatus comprising:

a pattern printing unit, for printing first and second predetermined patterns of images on a medium;

a distance difference detection unit, for detecting a distance difference between printing positions of the first and second thermal heads by using the first and second predetermined printed patterns; and a data transforming unit, for transforming the target image data to adjust alignment in subpixel units.

12. The apparatus according to claim 11, wherein the first and second thermal heads are fixed to a frame.

13. The apparatus according to claim 11, wherein the pattern printing unit comprises:

a moving unit, for moving the medium;

first and second thermal heads, for applying heat to the medium to print the images; and a print control unit, for printing predetermined images on the medium in a predetermined interval and to control the moving unit and the first and second thermal heads to print the first and second predetermined patterns.

14. The apparatus according to claim 11, wherein the first and second predetermined patterns are printed to transform the interval between the printed images in subpixel units.

15. The apparatus according to claim 11, wherein the distance difference detection unit is configured to detect the distance difference between the first and second thermal heads in subpixel units by using the first and second predetermined printed patterns.

16. The apparatus according to claim 11, wherein the data transformation unit comprises:

a data moving unit, for moving at least one of the image data printed by the first and second thermal heads by a distance difference, in one pixel units of the detected distance difference; and a data correction unit, for correcting the moved image data by using a distance difference, in subpixel units of the detected distance difference.

17. The apparatus according to claim 16, wherein the data correction unit is configured to correct pixel data of the moved image data by adding or subtracting a predetermined ratio of a distance difference between the pixel data of the moved image data and adjacent pixel data thereto, respectively, and wherein the predetermined ratio is comprised of a ratio of the distance difference in subpixel units of the detected distance difference.

18. The apparatus according to claim 16, further comprising:

a data rotation unit, for converting the image data such that the target image is rotated 90 degrees.

19. A computer-readable medium having embodied thereon a computer program for adjusting alignment of an image forming device using at least first and second thermal heads, the computer-readable medium comprising:

(a) a first set of instructions for printing first and second predetermined patterns of images on a medium by using the first and second thermal heads, respectively;

(b) a second set of instructions for detecting a distance difference of print positions between the first and second thermal heads by using the first and second predetermined printed patterns; and (c) a third set of instructions for transforming image data printed by the first and second thermal heads based on the detected distance difference to adjust alignment in subpixel units.

* * * * *